United States Patent [19]

Köhler et al.

[11] 3,997,117

[45] Dec. 14, 1976

[54] FUEL INJECTION VALVE FOR INTERNAL COMBUSTION ENGINES

[75] Inventors: Wolfgang Köhler, Dusseldorf; Dieter Schlundt, Bensberg-Frankenforst, both of Germany

[73] Assignee: Klockner-Humboldt-Deutz Aktiengesellschaft, Cologne, Germany

[22] Filed: Jan. 6, 1976

[21] Appl. No.: 646,752

[30] Foreign Application Priority Data

Jan. 9, 1975 Germany ..... 2500644

[52] U.S. Cl. ..... 239/533.8

[51] Int. Cl.[2] ..... B05B 1/30

[58] Field of Search ..... 239/533, 93, 88

[56] References Cited

UNITED STATES PATENTS

| | | | |
|---|---|---|---|
| 3,394,891 | 7/1968 | Voit | 239/533 |
| 3,777,977 | 12/1973 | Regneault | 239/533 X |

*Primary Examiner*—John J. Love
*Assistant Examiner*—Michael Mar
*Attorney, Agent, or Firm*—Walter Becker

[57] ABSTRACT

A fuel injection valve for internal combustion engines with a valve needle which is adapted to be opened by the fuel pressure against the thrust of a first spring. The valve needle is in a parallel arrangement to the first spring additionally placed under load by the fuel to which end a buffer chamber preceding that end face of the nozzle needle which is located opposite the conical nozzle tip, communicates through a first nozzle with the fuel pressure line. The buffer chamber communicates through a second throttle with a fuel leakage line while the connecting line to the leakage line is controlled by a spring loaded reversing valve, as soon as the valve needle opens. This reversing valve opens the connection between the first connecting line leading to the buffer chamber and the fuel pressure line and closes the second connecting line normally connecting the buffer chamber with the fuel leakage line.

7 Claims, 3 Drawing Figures

FUEL INJECTION VALVE FOR INTERNAL COMBUSTION ENGINES

The present invention relates to a fuel injection valve for internal combustion engines which has a valve needle continuously urged by a spring into closing position and which is adapted to be opened by the fuel pressure against the thrust of the spring while the valve needle in addition to being under the load of a spring is also additionally under the load of the fuel while a buffer chamber preceding said valve needle is through a throttle connected to the fuel pressure conduit.

The customarily employed fuel injection valves with a spring loaded valve needle show, due to the different cross sections upon which the fuel acts in closed and in opened condition, a difference between the opening and the closing pressure. Since for the opening operation only the annular cross section outside the valve needle seat is decisive whereas for the closing operation the entire cross section of the valve needle is decisive, the closure pressure of the valve is always less than its opening pressure.

For the course of combustion, this effect is not desired because the fuel is within the injection region, after the peak pressure has been reached, atomized with dropping pressure always to a poorer extent and in most instances finds insufficient conditions prevailing for the thermal favorable combustion.

A fuel injection valve of the above mentioned general type has become known. According to this known type of fuel injection valve, the valve needle is acted upon by the fuel in parallel to a loading spring, said fuel being conveyed from the fuel pressure line through a throttle area into a buffer chamber which is arranged at the face side of the valve needle. Due to the increasing conveying pressure, the valve needls is lifted as soon as the spring force has been overcome. At the same time, through the throttle area, fuel passes into the buffer chamber in which due to the throttling action the fuel pressure builds up with a delay according to the pressure in the pressure line. This delay must be so great that during the injection period, the fuel pressure and the spring pressure in the buffer chamber does not exceed the fuel pressure prevailing at the valve needle seat. At the end of the fuel injection, the fuel pressure conduit will be relieved so that pressure conditions now invert. By means of the higher fuel pressure in the buffer chamber, the valve needle is closed quickly. The closure is effected at the higher pressure than with a fuel injection valve of the customary construction.

However, as a rule, the fuel pressure in the pressure line does not drop to zero but for purposes of avoiding cavitation is held at a higher value by special devices. In view of the dynamic occurrences on the pressure side of the fuel injection system, it is generally not possible for all types of operations to obtain the same constant relief pressure in the pressure line. Furthermore, the pressure in the buffer chamber increases more or less depending on the speed of the engine, before the valve needle opens. Thus, also the starting conditions in the buffer chamber are different whereby the opening pressure of the valve needle becomes dependent on the load and at any rate at the speed of the engine. This is undesirable also in view of the above mentioned reasons and due to the distribution or scattering of the injected quantities of fuel.

It is, therefore, an object of the present invention with simple means to create a fuel injection valve the closure pressure of which is increased over its opening pressure beyond the value determined by the needle and seat geometry.

It is another object of this invention to provide a fuel injection valve according to the preceding paragraph which will be independent of the relief condition of the pressure line and also independent of the speed of the engine.

These and other objects and advantages of the invention will appear more clearly from the following specification in connection with the accompanying drawings, in which.

Figure 1:
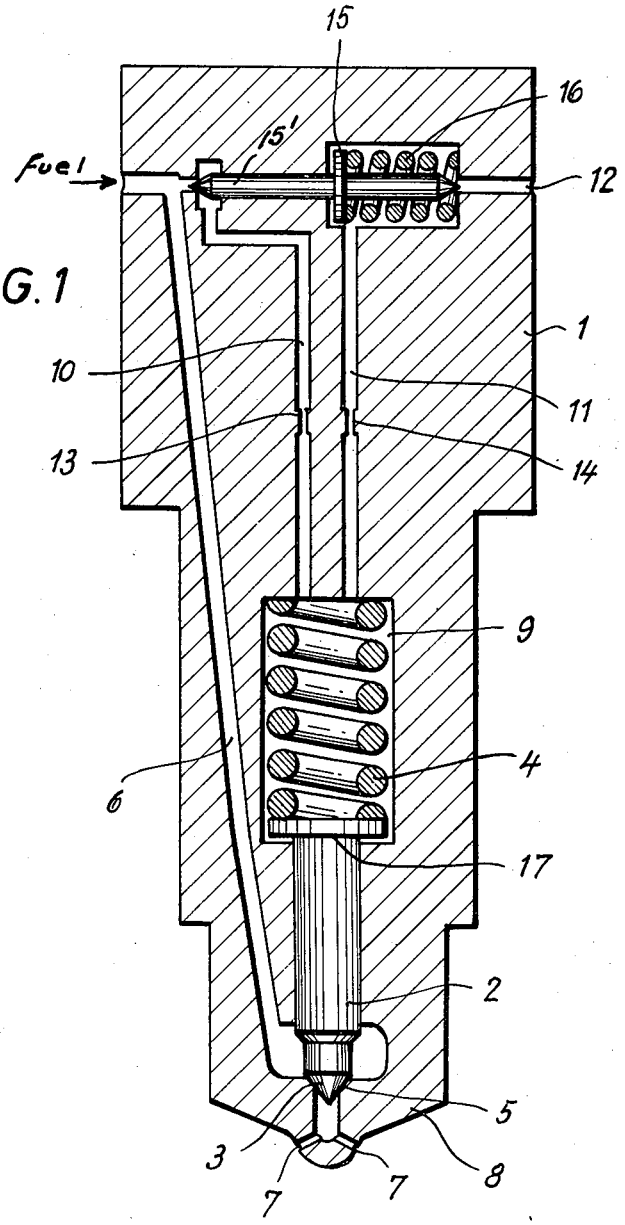
FIG. 1 illustrates a diagrammatic longitudinal section through a fuel injection valve according to the invention.

The fuel injection valve according to the present invention is characterized primarily in that the buffer chamber is through a second throttle connected to a fuel leakage conduit and that the connecting line from the fuel pressure line and the connecting line toward the leakage fuel line are controlled by a spring loaded reversing valve which opens the connecting line from the fuel pressure line and closes the connecting line to the fuel leakage oil line as soon as the valve needle has opened.

Due to the design set forth above, it will be brought about that shortly after the valve needle has opened, the connection between the fuel pressure line and the buffer chamber is opened. Only from this time period on, a pressure builds up with delay through the throttle in the buffer chamber without the opening pressure of the valve needle being affected in conformity with the speed of the engine. The connecting line to the fuel leakage oil line is closed. With the relief of the fuel pressure line, the reversing valve closes the connecting line from the fuel pressure line to the buffer chamber and opens the connecting line toward the fuel leakage oil line. The first still prevailing pressure in the buffer chamber brings about a quick closure of the valve needle. Thereupon the pressure at the second throttle toward the fuel leakage oil line will be reduced. Inasmuch as the fuel leakage oil line is pressureless, also the buffer chamber becomes pressureless so that each working cycle for the buffer chamber will start at the pressure level zero. As a result thereof, over the entire range of operation, a uniform opening pressure and increased closing pressure is obtained whereby the injection law with regard to a uniform atomization and good combustion course is considerably improved with a low emission of harmful gases.

Principally, it is possible that the fuel acts directly from the buffer chamber upon the end face of the valve needle. However, according to a further development of the invention, it is advantageous to provide in the buffer chamber a hydraulic piston which actuates the valve needle. Due to adapting the diameter of the hydraulic piston to the diameter of the valve needle, it is possible to realize a hydraulic transmission ratio which is adapted to the conditions of operation.

According to a further development of the invention, the reversing valve comprises an axially movable valve needle which by means of a conical seat controls the connecting line from the fuel pressure line and by means of a flat seat controls a connection line to the leakage fuel line.

According to another feature of the invention, the valve needle of the reversing valve is guided in a separate valve body in which the conical seat and the two throttles are worked in. The said separate valve body is by means of a hollow pressure screw in which the spring is arranged tightened by means of a valve plate in which there are provided connecting passages to the leakage fuel conduit and a flat seat.

According to a still further development of the invention, the valve plate has a central bore through which extends the reversing valve needle with a pivot-shaped extension and from which extend bores which lead into an annular passage.

According to an advantageous arrangement, the annular passage is formed by a bevel at the circumference of the valve plate.

The above outlined features concern embodiments which permit an advantageous manufacture and assembly of the reversing valve which is also suitable for a later installation in already installed fuel injection valves. Due to the employment of a bevelled seat and a flat seat, the difficulty is avoided which occurs when sealing two coaxial bevelled seats. In this connection, it is advantageous to control the connecting line to the leakage fuel conduit by means of the conical seat because in this way in view of a better seal of the pressure line it will be assured that no pressure builds up in the buffer chamber prior to the opening of the valve needle. Furthermore, the danger that due to leakage the injected quantity of fuel will be changed is reduced to a minimum.

Referring now to the drawings in detail, a nozzle needle 2 is guided in the nozzle holding housing 1. The conical tip 3 of said needle 2 is by means of a spring 4 pressed against a seat 5 whereby a fuel pressure line 6 is closed. The arrangement according to the invention furthermore comprises nozzle bore 7 of a fuel injection nozzle 8.

Figure 3:
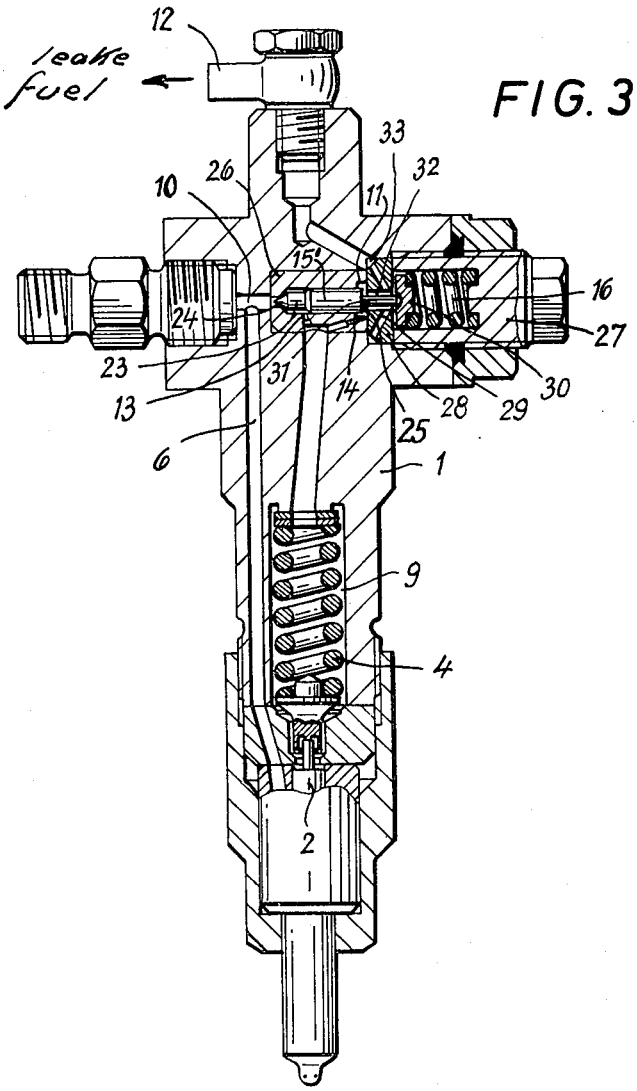
FIG. 3 represents a longitudinal section through a fuel injection valve according to the invention with a particular design of the reversing valve.

Spring 4 is arranged in a spring chamber 9 which in the embodiment of FIGS. 1 and 3 simultaneously serves as buffer chamber. The spring chamber 9 or buffer chamber is through a connecting line 10 connected to the fuel pressure line 6 and through a further connecting line 11 is connected to a leakage fuel conduit 12. In the connecting lines 10 and 11 there are provided throttles 13 and 14 which for purposes of adaptation to the conditions of operation may be made variable. Furthermore, the connecting lines are controlled by a reversing valve 15 which is under the load of a spring 16 and in rest position closes off the connecting line 10 while opening the connecting passage 11. The throttles 13 and 14 may be arranged in the flow directions of the fuel and also ahead or past the reversing valve 15.

The operation of the fuel injection valve according to the invention is as follows:

The fuel is conveyed through fuel pressure line 6 by a non-illustrated fuel injection pump, into the fuel injection valve. When a pressure is reached which is predetermined by the tension of the spring 4, the valve needle 2 opens and the injection operation starts. By adapting the spring 4 to the spring 16 it will be realized that the reversing valve 15 frees the connecting passage 10 as soon as the valve needle 2 is opened. Thereupon through the throttle 13 a fuel pressure builds up in the spring and buffer chamber 9 which fuel pressure acts upon the end face 17 of the valve needle 2 and by means of spring 4 immediately closes the valve needle 2 when the pressure line 6 is relieved. The throttle 13 is so designed that the fuel pressure in the buffer chamber and the spring force close the valve needle 2 only when the fuel pressure line 6 is relieved. When the fuel pressure conduit 6 is relieved, also the reversing valve 15 closes the connecting line 10 from the fuel pressure line to the buffer chamber 9 and opens the connecting line to the leakage fuel line 12. During the reversing phase, the pressure in the buffer and spring chamber 9 likewise slightly decreases through the throttles 13 and 14 and eventually drops to zero through the connecting line 11.

In this way, it will be assured that at the start of each fuel injection, the same conditions prevail in the buffer chamber.

Figure 2:
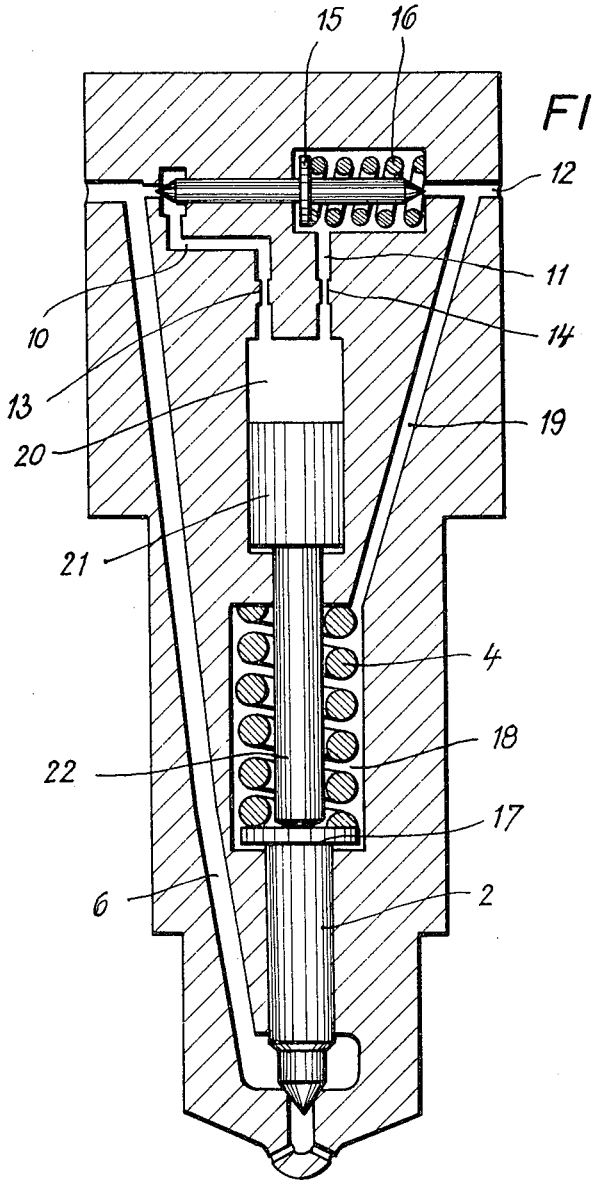
FIG. 2 shows a diagrammatic longitudinal section through a fuel injection valve according to the invention with a hydraulic piston.

The embodiment of FIG. 2 is characterized by the feature that the spring 4 is arranged in a special spring chamber 18 which through the bore 19 communicates with the leakage fuel line 12. Furthermore, there is provided a buffer chamber 20 in which a hydraulic piston 21 is axially movably arranged which piston by means of an extension 22 at the end face acts through the intervention of spring 4 upon the end face 17 of the needle valve 2.

The reversing valve 15' according to the embodiment of FIG. 3 has a movable valve needle 2 which by means of a conical seat 24 controls the connecting line 10 from the fuel pressure line 6 and by means of a flat seat 25 controls the connecting line toward the leakage fuel line 12. The reversing valve needle 23 is arranged in a separate valve body 26 in which the valve seat 24 and the throttles 13 and 14 are worked in. The valve body 26 is clamped in the nozzle holder housing 1 by means of a hollow pressure screw 27 with a valve plate 28 in which there are provided the connecting passages 29 to the leakage fuel conduit 12, and the flat seat 25. In the hollow pressure screw 27 there is arranged the spring 16 which through a spring plate 30 acts upon a pivot-shaped extension 31 of the reversing valve needle 23. The extension 31 extends through a central bore 32 of the valve plate. From the central bore 32 extend connecting passages 29 and lead into an annular passage 33 which is formed by a bevel at the circumference of the valve plate 28 and which is connected to the leakage fuel line 12.

The lower end of nozzle needle 2 and the cooperating end of the fuel pressure line 6 correspond to the showing of FIGS. 1 and 2.

The embodiment of FIG. 3 comprises individual elements which are easy to manufacture and which can also be installed in already made fuel injection valves.

It is, of course, to be understood that the present invention is, by no means, limited to the specific showing in the drawings, but also comprises any modifications within the scope of the appended claims.

What we claim is:

1. A fuel injection valve for internal combustion engines, which includes: nozzle housing means having nozzle opening means and a nozzle seat, a nozzle needle having a conical tip and being movable from a first position in which said nozzle needle tip rests on said nozzle seat and closes said nozzle opening means to a second position in which said nozzle needle tip opens said nozzle opening means, and vice versa, said housing means including a buffer chamber, first spring means associated with said nozzle needle and continuously urging said nozzle needle to move to said first position, said nozzle needle having a surface adapted to be exposed to fuel under pressure for moving said nozzle needle against the thrust of said first spring means from said first position to said second position, a fuel pressure line connectable to a fuel injection pump and adapted to convey fuel under pressure to said nozzle surface for moving said nozzle needle to said second position, first conduit means connecting said fuel pressure line with said buffer chamber, first throttle means interposed in said first conduit means, a fuel leakage line, reversing valve means interposed between said fuel pressure line and said fuel leakage line, second conduit means communicating with said buffer chamber and said reversing valve means, and second throttle means interposed in said second conduit means, said reversing valve including a control member movable to control communication between said first conduit means and said fuel pressure line and also communication between said second conduit means and said leakage fuel line, and second spring means associated with said reversing valve means and continuously urging said control member into a first control position in which communication between said fuel pressure line and said first conduit means is interrupted and communication between said second conduit means and said leakage fuel line is established, said control member being operable in response to the fuel pressure in said fuel pressure line overcoming the thrust of said second spring means to establish communication between said fuel pressure line and said first conduit means while interrupting communication between said second conduit means and said leakage fuel line.

2. A valve according to claim 1, which includes a fuel pressure operable piston reciprocable in said buffer chamber and having an extension for actuating said nozzle needle in the direction toward said nozzle seat.

3. A valve according to claim 1, in which said control member is an axially movable valve needle having a conical tip, and in which said reversing valve has a conical seat cooperating with said last mentioned conical tip for controlling communication of said pressure fuel line with said first conduit means, said valve needle also having a flat surface, and said reversing valve having a flat seat for cooperation with said flat surface to control communication of said second conduit means with said fuel leakage line.

4. A valve according to claim 3, in which said reversing valve includes a separate valve body guiding said valve needle and comprising said conical seat and said two throttles, said reversing valve also including a hollow pressure screw having said second spring means arranged therein, and furthermore including a valve plate, said valve body being connected to said valve plate by means of said hollow pressure screw, said valve plate comprising conduit means respectively communicating with said second throttle means and said leakage fuel line.

5. A valve according to claim 4, in which said valve plate has a central bore, and in which said reversing valve needle has an extension extending through said central bore, said valve plate being provided with additional bores leading from said central bore to a circular passage formed at least in part by said valve plate.

6. A valve according to claim 5, in which said circular passage is formed in part by a bevel on said valve plate.

7. A valve according to claim 1, in which said nozzle housing means comprises a chamber housing said first spring means and serving as buffer chamber.

* * * * *